US006276247B1

(12) United States Patent
Helda

(10) Patent No.: US 6,276,247 B1
(45) Date of Patent: Aug. 21, 2001

(54) ADJUSTABLE PUNCH ASSEMBLY WITH RELEASABLE LOCKING

(75) Inventor: Eric J. Helda, Cheektowaga, NY (US)

(73) Assignee: Strippit, Inc., Akron, NY (US)

( * ) Notice: Subject to any disclaimer, the term of this patent is extended or adjusted under 35 U.S.C. 154(b) by 0 days.

(21) Appl. No.: 09/519,041

(22) Filed: Mar. 3, 2000

(51) Int. Cl.[7] ..... B26F 1/14
(52) U.S. Cl. ..... 83/684; 83/686; 83/698.91
(58) Field of Search ..... 83/698.91, 686, 83/698.71, 684, 697

(56) References Cited

U.S. PATENT DOCUMENTS

| | | | | |
|---|---|---|---|---|
| 3,563,124 | * | 2/1971 | Gargrave | 83/698.91 |
| 4,375,774 | | 3/1983 | Wilson et al. | 83/140 |
| 5,131,303 | | 7/1992 | Wilson et al. | 83/140 |
| 5,329,835 | | 7/1994 | Timp et al. | 83/686 |
| 5,647,256 | * | 7/1997 | Schneider | 83/686 |
| 5,934,165 | * | 8/1999 | Chatham | 83/143 |
| 6,047,621 | * | 4/2000 | Dries et al. | 83/698.91 |

* cited by examiner

*Primary Examiner*—M. Rachuba
(74) *Attorney, Agent, or Firm*—Simpson, Simpson & Snyder, PLLC

(57) ABSTRACT

An adjustable punch assembly includes a releasable locking means for selectively allowing relative rotation between a threadably mated punch cap and punch driver for punch length adjustment. The releasable locking means includes a locking element, preferably a ball bearing, residing in a passage extending in a radial direction in the punch cap to open opposite a splined index portion of the punch driver. The splined index portion includes a plurality of angularly spaced grooves each extending in an axial direction of the punch driver, whereby a corresponding groove opposite the passage is engaged by the locking element. A plunger in its locked position confines the locking element in locking engagement with the punch cap and punch driver, and is movable to an unlocked position wherein the locking element is no longer confined in locking engagement to permit punch length adjustment.

6 Claims, 2 Drawing Sheets

FIG. 1
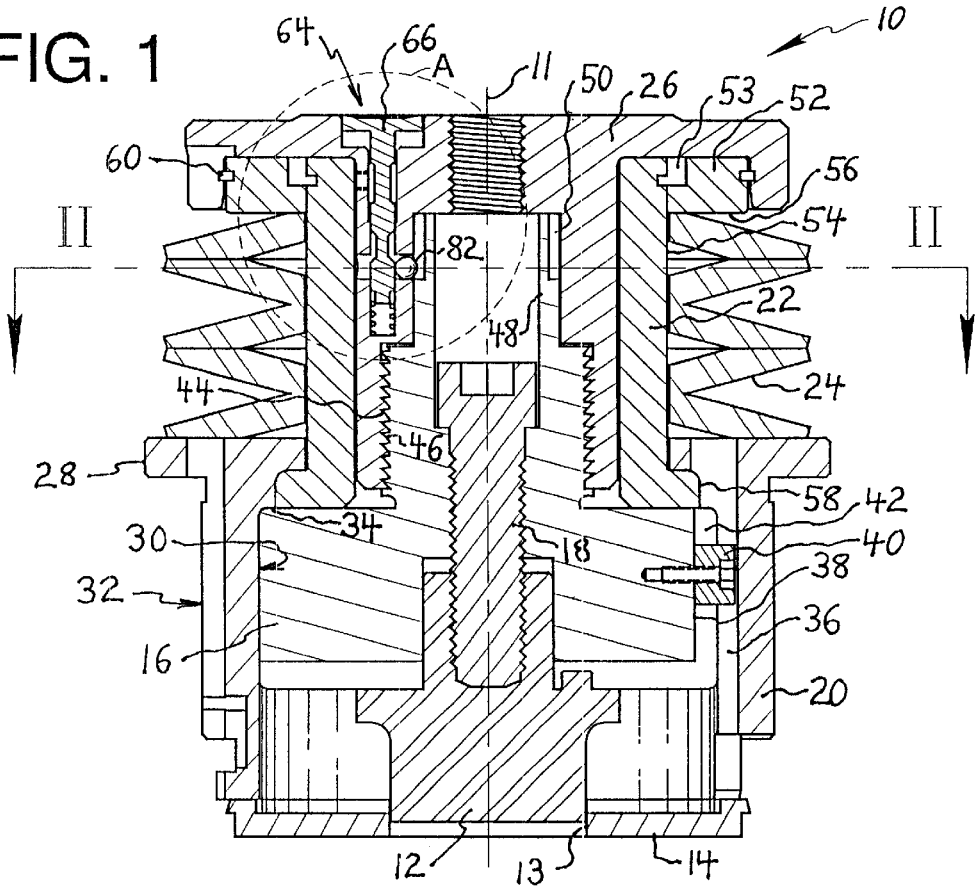
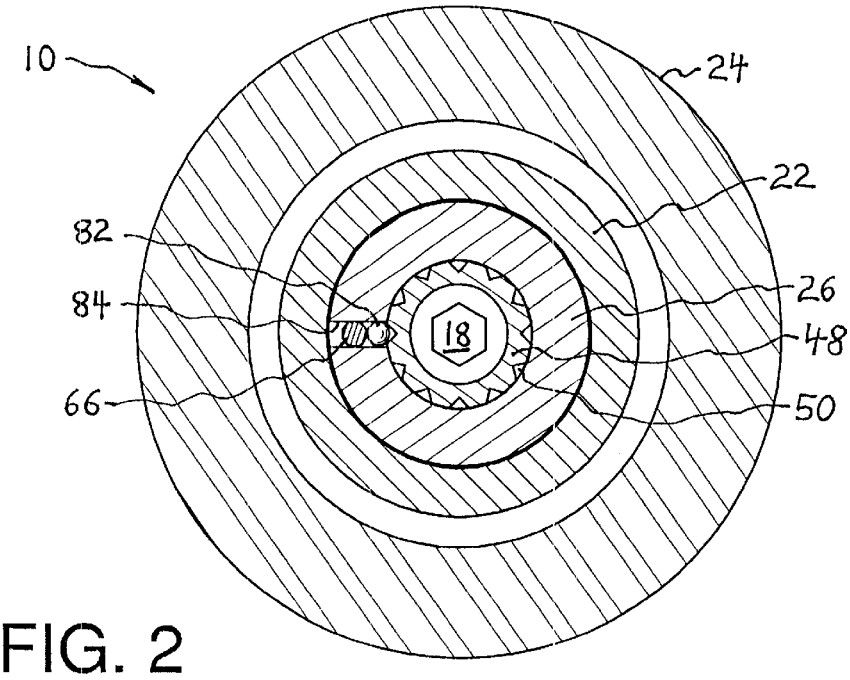
FIG. 2

ADJUSTABLE PUNCH ASSEMBLY WITH RELEASABLE LOCKING

BACKGROUND OF THE INVENTION

A. Field of the Invention

The present invention relates generally to the field of tooling for punch presses, and more particularly to adjustable-length punch assemblies for punch presses wherein the punch assembly may be adjusted to compensate for losses in punch blade length as a result of sharpening.

B. Description of the Prior Art

In punching operations, the distance between the sharpened edge of the punch tip and the workpiece is a critical dimension. When a dulled punch tip is reground to restore a sharp edge, material loss changes this critical dimension. To account for this, adjustable punch assemblies that allow punch length adjustment have been developed.

U.S. Pat. No. 4,375,774 discloses an adjustable punch assembly wherein a punch (12) is carried by an axially guided punch driver (13), which in turn is threadably mated with a punch head or cap (14), whereby punch length is adjustable by rotating the punch cap relative to the punch driver. An expandable locking dowel pin (58) is wedged in aligned holes (59) in the punch cap and punch driver as a releasable locking means for preventing relative rotation between the punch cap and punch driver. The locking pin must be temporarily removed by the operator to enable length adjustment.

Another adjustable punch assembly is described in U.S. Pat. No. 5,131,303. The described punch assembly includes a punch (20) threadably mated with a punch driver (10) to enable axial length adjustment by relative rotation of the mating parts. As shown in FIGS. 4 and 5 of this patent, a C-shaped spring clip (30) having a radial protrusion (39) at one end thereof fits within an annular groove (31) in the mating end of the punch driver, and protrusion (39) extends through a radial aperture (33) for receipt within a V-shaped recess 32 in the punch. The spring clip 30 is constrained in a locking position by an outer punch guide (40), which must be temporarily removed for sharpening and punch length adjustment.

U.S. Pat. No. 5,329,835 teaches an adjustable punch assembly having a pushbutton releasable locking means (50) operable along the central axis of the punch assembly. More specifically, a punch cap (26) is threadably mated with a tool-holding punch driver (14), and push button (50) includes four comer detents (55), (57), (59), and (61) normally engaged with four corresponding detent stops from a plurality of circumferential detent stops (70) in the punch cap (26) and also engaged with four corresponding detent stops (55'), (57'), (59'), and (61') in the punch driver. The push button can be depressed in an axial direction against the bias of a spring to disengage the comer detents from the detent stops (70), thereby releasing the punch cap for adjustment rotation relative to the punch driver.

A more recent adjustable punch assembly is disclosed in U.S. Pat. No. 5,647,256. The disclosed punch assembly includes a punch cap (28) threadably mated with a punch driver (18) to permit length adjustment by rotating the parts relative to one another. A spring seat (32) is provided coaxially with the punch cap and punch driver adjacent the punch cap, and a releasable securing member (38) prevents relative rotation between the spring seat and the punch cap to indirectly prevent adjustment rotation between the punch cap and punch driver. The releasable securing member is radially depressible against a spring bias to uncouple the punch cap from the spring seat to enable adjustment rotation between the punch cap and punch driver.

The prior art adjustable punch assemblies mentioned above are complex to manufacture and/or require some disassembly to carry out length adjustment.

SUMMARY OF THE INVENTION

It is therefore an object of the present invention to provide an improved punch assembly that allows a user to adjust punch length quickly and accurately to reduce set up time.

It is another object of the present invention to provide an improved punch assembly with releasable locking means for threaded punch length adjustment that is easy to manufacture and reliable over time.

In accordance with the present invention, a punch assembly comprises a guide bushing for axially guiding a punch driver carrying a punch tool, a spring tube telescopically connected to the guide bushing for axially directed movement relative thereto, a stripper spring for biasing the spring tube in an axially extended direction relative to the guide bushing, a punch cap coupled to the spring tube and threadably mated with the punch driver for adjusting axial punch length by rotation relative to the punch driver, and a releasable locking means movable between locked and unlocked positions for preventing and allowing punch length adjustment, respectively.

The punch driver includes a splined index portion having a plurality of angularly spaced grooves elongated in an axial direction, and the punch cap includes a radially extending passage opposite the splined index portion of the punch driver. In a preferred embodiment of the present invention, the releasable locking means includes a ball bearing as a locking element partially received in one of the grooves and in the passage to simultaneously engage the punch driver and the punch cap to prevent relative rotation therebetween. A plunger movable in an axial direction within a plunger channel in punch cap has an enlarged trapping portion alignable with the passage to confine the ball bearing in simultaneous engagement with the punch driver and punch cap and a reduced releasing portion alignable with the passage to permit the ball bearing to disengage from the punch driver by rolling out of the corresponding groove in the splined index portion of the punch driver. The plunger is spring-biased to reside in a locking position wherein its trapping portion is aligned with the passage to confine the ball bearing, and the plunger is manually depressible against the biasing force to a position wherein the releasing portion of the plunger is aligned with the passage.

BRIEF DESCRIPTION OF THE DRAWINGS

The nature and mode of operation of the present invention will now be more fully described in the following detailed description of the preferred embodiments taken with the accompanying drawing figures, in which:

FIG. 1 is a cross-sectional view of a punch assembly formed in accordance with a preferred embodiment of the present invention;

FIG. 2 is a sectional view thereof taken generally along the line II—II in FIG. 1;

DETAILED DESCRIPTION OF THE PREFERRED EMBODIMENTS

Figure 3A:
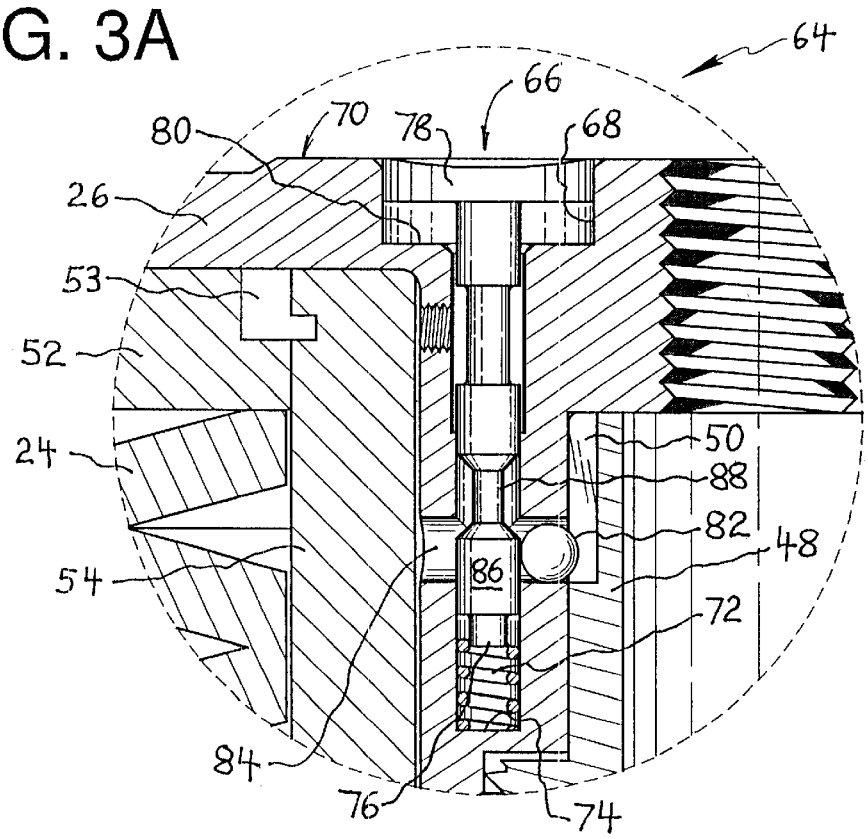
FIG. 3A is an enlarged view of region "A" in FIG. 1 showing releasable locking means of the present invention in a locked position.

Referring to FIG. 1 of the drawings, a punch assembly according to a preferred embodiment of the present invention is shown and identified by the reference numeral 10. Punch assembly 10 is designed for use in automatic punch presses for repeatedly performing hole-punching operations in sheet metal and the like. The illustrated punch assembly 10 operates along a central punch axis 11 and generally comprises an interchangeable punch 12 movable through a passage 13 in a stripper plate 14, a punch driver 16 to which punch 12 is mounted by an axial draw bolt 18, an outer guide bushing 20, a two-piece spring tube 22 slidably guided with punch driver 16 in guide bushing 20, a stripper spring 24 surrounding the spring tube 22, and a punch cap 26 impacted during a punch press stroke to impart force to punch driver 16 and ultimately to punch 12.

Guide bushing 20 is adapted at its bottom end in a known manner for releasable attachment of stripper plate 14. The top end of guide bushing 20 includes an enlarged circumferential shoulder flange 28 extending both radially inward from an inner wall surface 30 of the guide bushing and radially outward from an outer wall surface 32 of the guide bushing. Inner wall surface 30 of guide bushing 20 includes a radial step 34 near shoulder flange 28 and an internal keyway 36 extending in an axial direction of the guide bushing.

Spring tube 22 is telescopically connected to guide bushing 20 for axially directed sliding motion relative thereto during a punch stroke. Spring tube 22 is formed by an upper flange portion 52 coupled with a lower tube portion 54 by a stepped ring 53. The upper flange portion 52 provides a spring seat 56 opposite shoulder flange 28 of guide bushing 20, whereby stripper spring 24 is captured between the guide bushing and spring tube 22 to bias the spring tube in an axially extended direction relative to the guide bushing. A radially enlarged lower flange 58 on lower tube portion 54 engages shoulder flange 28 of guide bushing 20 to retain spring tube 22 in telescopic connection with the guide bushing against the urging of stripper spring 24. Punch cap 26 is connected to spring tube 22 by a retaining member 60 received within opposing circumferential grooves in punch cap 26 and upper flange portion 52 to prevent axially directed relative movement between the punch cap and spring tube.

Punch driver 16 includes an enlarged punch-mounting portion 38 sized for axially guided sliding movment within guide bushing 20 and prevented from rotation relative to the guide bushing by a punch body key 40 fixed to extend radially from an external channel 42 in punch driver 16 for receipt within keyway 36 of the guide bushing. Punch driver 16 further includes an externally threaded mid-portion 44 sized for mating engagement with an internally threaded portion 46 of punch cap 26. Finally, pursuant to the present embodiment, punch driver 16 is provided with a splined index portion 48 comprising a plurality of V-shaped grooves 50 angularly spaced at regular intervals about the circumference of index portion 48 and extending in an axial direction of punch assembly 10.

As is understood in the art of punch assemblies, adjustment of the axial length of punch assembly 10 is necessary after sharpening of the punch blade in order to account for the loss of punch length and maintain a constant punch depth for a particular punching operation. More specifically, the threaded mating of mid-portion 44 of punch driver 16 with threaded portion 46 of punch cap provides a mechanism for adjusting punch length by axially rotating punch cap 26 relative to punch driver 16. Of course, punch driver 16 and punch cap 26 must be locked against relative axial rotation once punch length has been set. Accordingly, the present invention comprises a releasable locking means 64 for directly engaging both the punch driver and punch cap to prevent relative rotation between these parts while enabling selective unlocking to permit punch length adjustment.

Figure 3B:
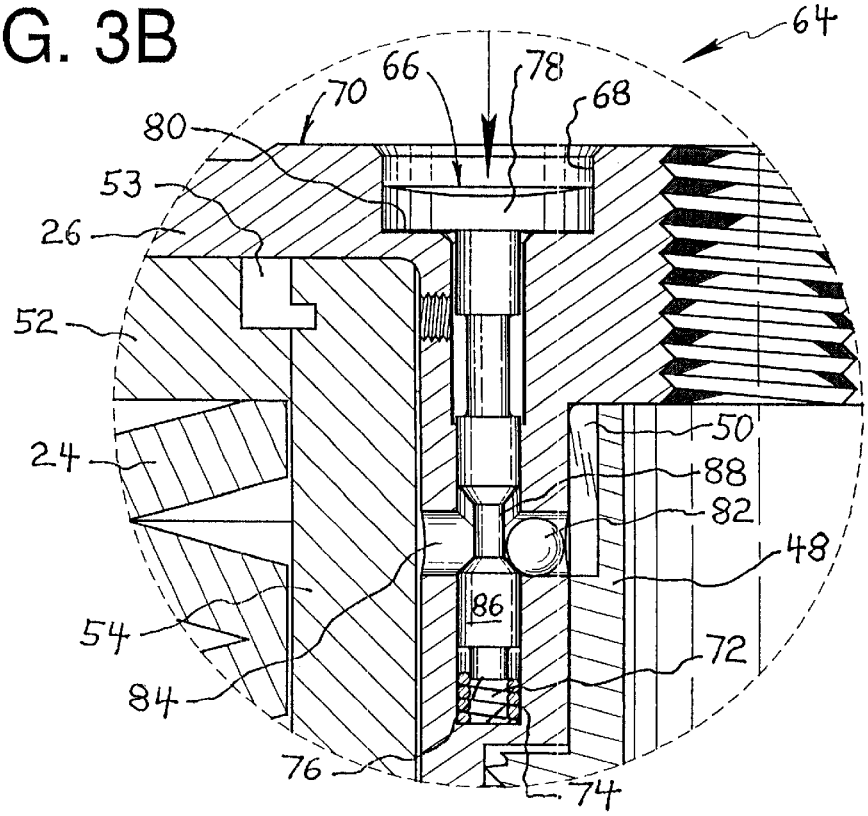
FIG. 3B is a view similar to that of FIG. 3A, however showing the releasable locking means in an unlocked position.

Referring also now to FIGS. 3A and 3B, releasable locking means 64 of the first embodiment is shown in detail in its locked and unlocked positions, respectively. Releasable locking means 64 includes a plunger 66 received within a plunger channel 68 formed through a top surface 70 of punch cap 26 at a position offset from central punch axis 11. Plunger channel 68 extends in an axial direction of punch assembly 10 to a region near internally threaded portion 46 of punch cap 26. A spring 72 is seated between a terminal surface 74 of plunger channel 68 and an innermost end 76 of plunger 66 for biasing plunger in the position shown in FIG. 3A. Plunger 66 includes an enlarged head 78 at its outermost end, and plunger channel 68 includes a radial step 80 at a depth which permits limited movement of plunger 66 in an axial direction against the urging of spring 72. Releasable locking means 64 further includes a locking element 82 residing in a passage 84 extending in a radial direction through punch cap 26. Locking element 82 is preferably a ball bearing chosen for its ability to roll along passage 84, however the present invention is not confined to the use of a spherical locking element. Passage 84 is located to intersect with plunger channel 68 such that plunger 66 confines locking element 82 within a radially inner portion of passage 84 that terminates opposite splined index portion 48 of punch driver 16.

As best seen in FIG. 3A, plunger 66 includes a trapping portion 86 which resides at the intersection of plunger channel 68 and passage 84 when releasable locking means 64 is in its normal locked position. Trapping portion 86 is sized to engage locking element 82 and prevent radially outward travel of the locking element in passage 84. Accordingly, locking element 82 is caused to partially extend from the radially inner end of passage 84 for receipt within a corresponding V-shaped groove 50 of splined index portion 48. When releasable locking means 64 is in its locked position shown in FIG. 3A, locking element 82 is contacted by both sides of corresponding V-shaped grove 50, by the wall of passage 84, and by trapping portion 86 of plunger 66. In this way, relative rotation between punch cap 26 and punch driver 16 is prevented. This locked condition can also be understood by referring to FIG. 2.

In FIG. 3B, releasable locking means 64 is moved to its unlocked position by depressing enlarged head 78 of plunger 66 to force the plunger in a downward direction against the bias of spring 72 until a releasing portion 88 of plunger 66 adjacent trapping portion 86 is positioned at the intersection of plunger channel 68 and passage 84. Releasing portion 88 is reduced in cross-section relative to trapping portion 86, thus allowing enough radially outward movement of locking element 82 within passage 84, such as by rolling or sliding, to entirely withdraw locking element 82 from corresponding V-shaped groove 50. Consequently, while plunger 66 is depressed, relative rotation between punch cap 26 and punch driver 16 is possible for threaded adjustment of punch length.

It will be appreciated that the V-shaped grooves 50 of splined index portion 48 are elongated in an axial direction to maintain locking element 82 in opposite relation to the V-shaped grooves as threaded length adjustment occurs between punch cap 26 and punch driver 16. Moreover, the number and angular spacing of V-shaped grooves 50 is preferably chosen such that adjustment rotation aligning locking element 82 with the next adjacent V-shaped groove results in a known length adjustment, for example 0.008 inches.

What is claimed is:

1. A punch assembly comprising:

a guide bushing;

a punch driver received and axially guided by said guide bushing, said punch driver comprising an external splined index portion having a plurality of angularly spaced grooves elongated in an axial direction;

a punch mounted for travel with said punch driver;

a spring tube telescopically connected to said guide bushing for axially directed movement relative to said guide bushing;

a stripper spring for biasing said spring tube in an axially extended direction relative to said guide bushing;

a punch cap threadably mated with said punch driver for adjusting a combined axial length of said punch cap, said punch driver, and said punch assembly by rotation of said punch cap relative to said punch driver, said punch cap comprising a radially extending passage opposite said splined index portion of said punch driver; and a releasable locking means for engaging said punch cap and said punch driver to prevent rotation of said punch cap relative to said punch driver when said releasable locking means is in a locked position, said releasable locking means being selectively movable to an unlocked position to permit rotation of said punch cap relative to said punch driver for adjusting said combined axial length, said releasable locking means comprising a radially movable locking element partially received in a selected one of said plurality of grooves and in said passage to simultaneously engage said punch driver and said punch cap when said releasable locking means is in said locked position.

2. The punch assembly according to claim 1, wherein said releasable locking means further comprises a plunger movable in an axial direction within a plunger channel in said punch cap communicating with said passage, said plunger having an enlarged trapping portion alignable with said radial passage to confine said locking element in simultaneous engagement with said punch driver and said punch cap and a reduced releasing portion alignable with said passage to permit said locking element to disengage from said punch driver by exiting said one of said plurality of grooves.

3. The punch assembly according to claim 1, wherein said locking element is a ball bearing.

4. The punch assembly according to claim 2, wherein said locking element is a ball bearing.

5. The adjustable punch assembly according to claim 2, wherein said plunger is biased to reside in a first position wherein said trapping portion of said plunger is aligned with said passage, and said plunger is manually movable against said biasing force to a second position wherein said releasing portion of said plunger is aligned with said passage.

6. The adjustable punch assembly according to claim 4, wherein said plunger is biased to reside in a first position wherein said trapping portion of said plunger is aligned with said passage, and said plunger is manually movable against said biasing force to a second position wherein said releasing portion of said plunger is aligned with said passage.

* * * * *